US010019939B2

(12) United States Patent
Lee et al.

(10) Patent No.: US 10,019,939 B2
(45) Date of Patent: Jul. 10, 2018

(54) ORGANIC LIGHT EMITTING DISPLAY DEVICE AND DRIVING METHOD THEREOF

(71) Applicant: Samsung Display Co., Ltd., Yongin-si, Gyeonggi-do (KR)

(72) Inventors: Jae Hoon Lee, Yongin-si (KR); Seung Ho Park, Yongin-si (KR); Do Hyung Ryu, Yongin-si (KR); Jae Woo Song, Yongin-si (KR); Hae Goo Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 115 days.

(21) Appl. No.: 15/140,332

(22) Filed: Apr. 27, 2016

(65) Prior Publication Data

US 2016/0351101 A1 Dec. 1, 2016

(30) Foreign Application Priority Data

Jun. 1, 2015 (KR) ..... 10-2015-0077348

(51) Int. Cl.
*G09G 3/32* (2016.01)
*G09G 3/3225* (2016.01)

(52) U.S. Cl.
CPC ... *G09G 3/3225* (2013.01); *G09G 2320/0238* (2013.01); *G09G 2320/0271* (2013.01);
(Continued)

(58) Field of Classification Search
CPC .. G09G 3/2007; G09G 3/3233; G09G 3/3266; G09G 3/3275; G09G 3/2081;
(Continued)

(56) References Cited

U.S. PATENT DOCUMENTS

2011/0069096 A1* 3/2011 Li ..... G09G 3/2081 345/690
2011/0084980 A1* 4/2011 Lee ..... G09G 3/3406 345/589

(Continued)

FOREIGN PATENT DOCUMENTS

KR 10-2014-0038146 A 3/2014
KR 10-2014-0078919 A 6/2014
KR 10-2014-0137859 A 12/2014

*Primary Examiner* — Richard Hong
(74) *Attorney, Agent, or Firm* — Lewis Roca Rothgerber Christie LLP

(57) ABSTRACT

An organic light emitting display device includes a display panel having pixels and a display panel driver driving the display panel. Each of the pixels includes an organic light emitting diode, and the display panel driver selects one of the pixels, determines a reference grayscale value, compares a grayscale value, and determines the selected pixel as a low grayscale pixel when the grayscale value is lower than the reference grayscale value and higher than a black grayscale value. Some of the low grayscale pixels display the black grayscale value when there are more than one neighboring low grayscale pixels. The reference grayscale value is determined based on a reference grayscale variable, and the reference grayscale variable includes at least one of a temperature of the display panel, a time period when the selected pixel emits light, and a wavelength of light emitted by the selected pixel.

11 Claims, 7 Drawing Sheets

(52) U.S. Cl.
CPC . *G09G 2320/041* (2013.01); *G09G 2320/048* (2013.01); *G09G 2320/0686* (2013.01)

(58) Field of Classification Search
CPC ..... G09G 3/3406; G09G 3/3225; G09G 2320/0238; G09G 2320/0271; G09G 2320/041; G09G 2320/048; G09G 2320/0686
See application file for complete search history.

(56) References Cited

U.S. PATENT DOCUMENTS

| | | | |
|---|---|---|---|
| 2014/0078031 | A1 | 3/2014 | Jang et al. |
| 2014/0168280 | A1 | 6/2014 | Lee |
| 2014/0347253 | A1 | 11/2014 | Lee |

* cited by examiner

GRAYSCALES WHICH CORRESPOND TO INPUT IMAGE SIGNALS

SCREEN DISPLAYED FOR FRAME 1

SCREEN DISPLAYED FOR FRAME 2

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2015-0077348, filed on Jun. 1, 2015, in the Korean Intellectual Property Office, the entire content of which is incorporated herein by reference in its entirety.

BACKGROUND

1. Field

The embodiments of the present invention relate to an organic light emitting display device and a driving method thereof.

2. Description of the Related Art

Recently, various display devices which can reduce a weight and a volume of a cathode ray tube CRT, which are drawbacks of the CRT, have been developed. Display devices include: a liquid crystal display device, a field emission display device, a Plasma Display Panel Device, and an organic light emitting display device (e.g., Organic Light Emitting Diode (OLED) display device).

The organic light emitting display device exploits the property in which an organic light emitting diode emits light when conducted. Here, when a level of luminance is lower than a set (e.g., predetermined) level, a blurring phenomenon may occur in the organic light emitting display device due to instability of a luminance to current efficiency. Therefore, studies for improving this blurring phenomenon have been under progress.

SUMMARY

An aspect of an embodiment of the present invention is directed toward an organic light emitting display device, which determines a reference grayscale value, which corresponds to a selected pixel using a reference grayscale variable and changes an image signal, which corresponds to the selected pixel when the grayscale value, which corresponds to the selected pixel is higher than a black grayscale value and lower than the determined reference grayscale value, and a method of driving the organic light emitting display device.

Another aspect of an embodiment of the present invention is directed toward an organic light emitting display device, which can perform a blur improving operation since the reference grayscale value is determined based on a state of the display panel, and a method of driving the organic light emitting display device.

A light emitting display device according to an embodiment of the present invention includes an organic light emitting display device including: a display panel including pixels, each of the pixels including an organic light emitting diode; and a display panel driver configured to drive the display panel, wherein the display panel driver is configured to: select one of the pixels, determine a reference grayscale value which corresponds to the selected pixel, compare a grayscale value which corresponds to the selected pixel with the reference grayscale value, and identify the selected pixel as a low grayscale pixel when the grayscale value which corresponds to the selected pixel is lower than the reference grayscale value and higher than a black grayscale value, wherein the low grayscale pixel displays the black grayscale value when there are more than one adjacent low grayscale pixels, wherein the reference grayscale value is determined based on a reference grayscale variable, and wherein the reference grayscale variable includes at least one of a temperature of the display panel, a time period when the selected pixel emits light, and a wavelength of light emitted by the selected pixel.

The pixels are arranged in a first direction and a second direction crossing the first direction, wherein the low grayscale pixel does not display the black grayscale value when the low grayscale pixel is adjacent the low grayscale pixel displaying the black grayscale value, and wherein the low grayscale pixel displays the black grayscale value when the low grayscale pixel is adjacent the low grayscale pixel not displaying the black grayscale value.

The reference grayscale variable includes the temperature of the display panel, wherein the reference grayscale value is determined as a first reference grayscale value when the temperature of the display panel is a first temperature, wherein the reference grayscale value is determined as a second reference grayscale value when the temperature of the display panel is a second temperature which is greater than the first temperature, and wherein the second reference grayscale value is higher than the first reference grayscale value.

The reference grayscale variable includes the time period when the selected pixel emits light, wherein the reference grayscale value is determined as a third reference grayscale value when the selected pixel emits light in a first time period, wherein the reference grayscale value is determined as a fourth reference grayscale value when the selected pixel emits light in a second time period which is longer than the first time period, and wherein the fourth reference grayscale value is higher than the third reference grayscale value.

The reference grayscale variable includes the wavelength of light emitted by the selected pixel, wherein the reference grayscale value is determined as a fifth reference grayscale value when the selected pixel emits light having a first wavelength, wherein the reference grayscale value is determined as a sixth reference grayscale value when the selected pixel emits light having a second wavelength which is shorter than the first wavelength, wherein the reference grayscale value is determined as a seventh reference grayscale value when the selected pixel emits light having a third wavelength which is shorter than the second wavelength, and wherein the sixth reference grayscale value is higher than the fifth reference grayscale value and lower than the seventh reference grayscale value.

The display panel driver includes a timing controller configured to receive image signals and timing signals from outside, the timing controller including a reference grayscale look-up table, and in response to the reference grayscale variable being inputted, the reference grayscale look-up table is configured to output a reference grayscale value which corresponds to the reference grayscale variable.

In response to the selected pixel being identified as the low grayscale pixel, the timing controller is configured to change the grayscale value which corresponds to the selected pixel to the black grayscale value or a grayscale value higher than the reference grayscale value which corresponds to the selected pixel.

A method of driving an organic light emitting display device according to an embodiment of the present invention includes, the organic light emitting display device including a display panel including pixels and a display panel driver configured to drive the display panel, each of the pixels including an organic light emitting diode, the method including: selecting one of the pixels; receiving a grayscale value which corresponds to the grayscale value of the pixel; determining a reference grayscale value which corresponds to the selected pixel; and comparing the determined reference grayscale value with the grayscale value which corresponds to the selected pixel.

The method further including: identifying the selected pixel as a low grayscale pixel when the grayscale value which corresponds to the selected pixel is higher than a black grayscale value and lower than the determined reference grayscale value.

The method further including: changing grayscale values which correspond to the low grayscale pixels, wherein some of the low grayscale pixels display the black grayscale value during the changing of the grayscale values.

The determining of the reference grayscale value which corresponds to the selected pixel includes: measuring a reference grayscale variable which corresponds to the selected pixel; and determining the reference grayscale value to the reference grayscale value which corresponds to the measured reference grayscale variable.

The measuring the reference grayscale variable includes at least one of: measuring a temperature of the display panel; measuring a time period when the selected pixel emits light; and measuring a wavelength of light emitted by the selected pixel.

The measuring the wavelength of light includes estimating the wavelength of the light based on a relative position of the selected pixel in the display panel.

The determining of the reference grayscale value to the reference grayscale value which corresponds to the measured reference grayscale variable, includes determining the reference grayscale value based on a reference grayscale look-up table in the display panel driver.

BRIEF DESCRIPTION OF THE DRAWINGS

Exemplary embodiments will now be described more fully hereinafter with reference to the accompanying drawings; however, they may be embodied in different forms and should not be construed as being limited to the embodiments set forth herein. Rather, these embodiments are provided so that this disclosure will be thorough and complete, and will fully convey the scope of the exemplary embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
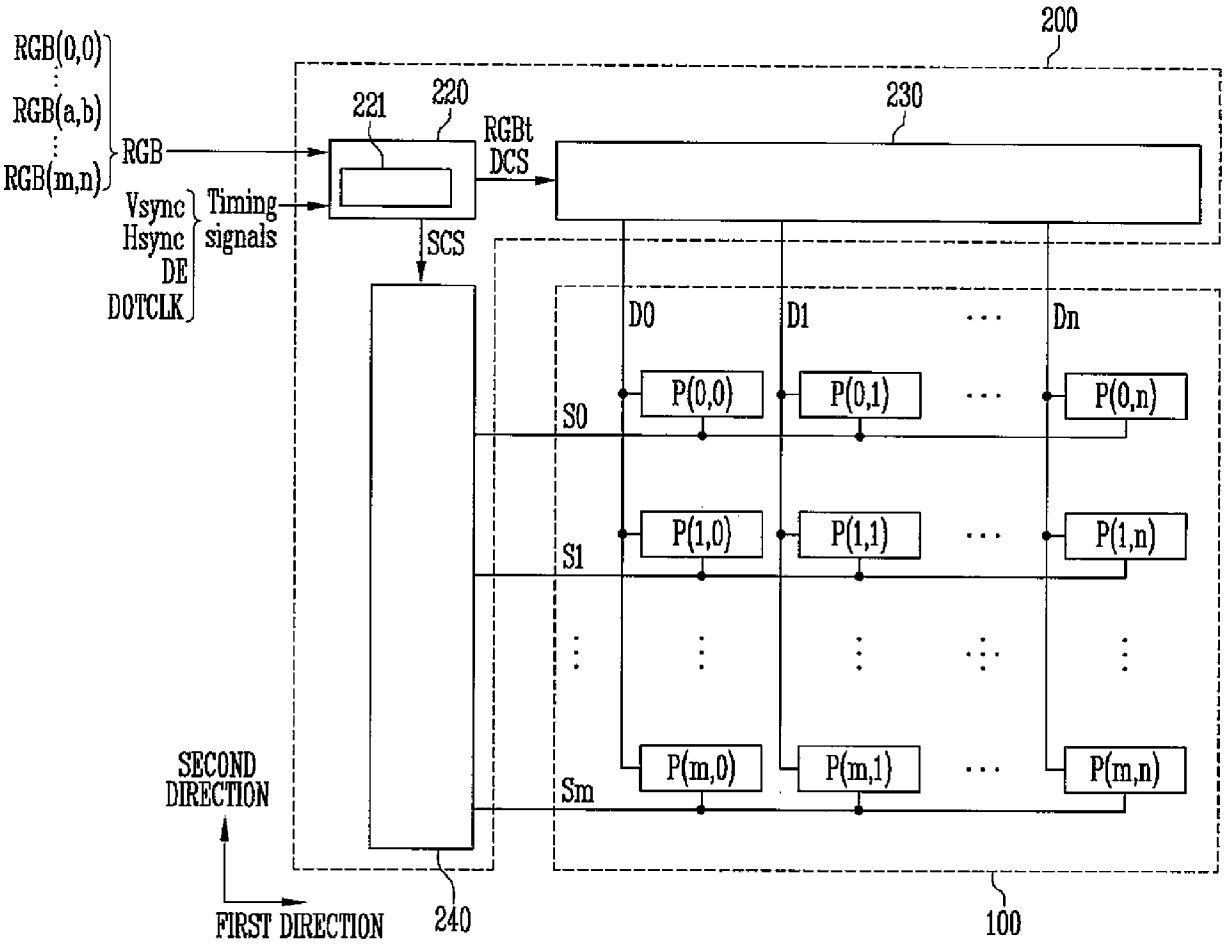
FIG. 1 is a diagram for describing an organic light emitting display device according to one embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

FIG. 1 is a diagram for describing an organic light emitting display device according to one embodiment of the present invention. The organic light emitting display device includes a display panel 100 and a display panel driver 200.

The display panel 100 includes pixels P(0, 0)-P(m, n) (m and n are positive integers), data lines D0-Dn ("D", hereinafter) for delivering data voltages to the pixels P(0, 0)-P(m, n) ("P", hereinafter), and scan lines S0-Sm ("S", hereinafter) for delivering scan signals to the pixels P. As for the pixels P, (n+1) pixels are arranged in a first direction while (m+1) pixels are arranged in a second direction. The scan lines S are extended in the first direction, while the data lines D are extended in the second direction which crosses the first direction, according to an embodiment. The power lines for driving the pixels P are omitted in FIG. 1, and the embodiment will be described in more detail in FIG. 2.

The display panel driver 200 generates data voltages and drives the display panel 100 by applying the data voltages to the data lines D and to the scan lines S. For example, the display panel driver 200 includes a timing controller 220, a data driver 230 and a scan driver 240. The timing controller 220, the data driver 230 and the scan driver 240 can be implemented as respective electronic devices, or the display panel driver 200 can be implemented as an integrated electronic device (for example, a display driving IC, etc.).

The timing controller 220 is supplied with image signals RGB and supplies converted image signals RGBt to the data driver 230. Also, the timing controller 220 is supplied with timing signals (Timing signals) and generates timing control signals for controlling operation timing of the data driver 230 and the scan driver 240. One of the image signals RGB (RGB(a, b); wherein a is an integer not less than 0 and not greater than m, and b is an integer not less than 0 and not greater than n) corresponds to a pixel P(a, b), and a grayscale corresponding to the pixel P(a, b) is determined based on a level of the image signal P(a, b). The grayscale value can have a value of an integer from 0 to 255, and 0 can be referred to as a black grayscale value, while 255 can be referred to as a white grayscale value. The higher the grayscale value (Gray) is, the more light the pixel emits. The timing signals include vertical synchronous signals Vsync, horizontal synchronous signals Hsync, data enable signals (Data Enable, DE) and dot clocks DOTCLK. The timing controller 220 selects one of the pixels P. For the convenience of explanation, it can be assumed that the pixel P(a, b) is selected. The timing controller 220 stores a reference grayscale look-up table 221, and the reference grayscale look-up table 221 stores a reference grayscale value which corresponds to a reference grayscale variable. When the reference grayscale look-up table 221 receives the reference grayscale variable, it outputs the reference grayscale value, which corresponds to the reference grayscale variable. The timing controller 220 inputs the reference grayscale variable, which corresponds to the pixel P(a, b) to the reference grayscale look-up table 221, and determines the reference grayscale value, which is outputted by the reference grayscale look-up table 221 as the reference grayscale value, which corresponds to the pixel P(a, b). The timing controller 220 compares the grayscale value, which corresponds to the pixel P(a, b), with the reference grayscale value, which corresponds to the selected pixel P(a, b). When the grayscale value, which corresponds to the pixel P(a, b), is higher than the black grayscale value and lower than the reference grayscale value, which corresponds to the pixel P(a, b), the timing controller 220 determines (identifies) that the pixel P(a, b) is a low grayscale pixel. After all the pixels P are selected and it is determined whether the pixels are low grayscale pixels, the timing controller 220 changes the grayscale values which correspond to the low grayscale pixels. Since the grayscales values are changed, the image signals which correspond to the low grayscale pixels are changed. That is, the timing controller 220 converts the image signals RGB to generate converted image signals RGBt. The reference grayscale variable can include at least one of a temperature of the display panel 100, a time period when the organic light emitting diode of the selected pixel emits light, and a wavelength of the light emitted by the selected pixel P(a, b).

The data driver 230 latches the converted image data RGBt inputted from the timing controller 220 in response to the data timing control signal DCS. The data driver 230 includes a plurality of source drive ICs, and the source drive ICs can be electrically connected to the data lines D of the display panel 100 via a COG (Chip On Glass) operation or a TAB (Tape Automated Bonding) operation.

The scan driver 240 sequentially applies scan signals to scan lines S in response to a scan timing control signal SCS. The scan driver 240 can be directly formed on a substrate of the display panel 100 via a GIP (Gate In Panel) process, or can be electrically connected to the scan lines S of the display panel 100 via the TAB process.

Figure 2:
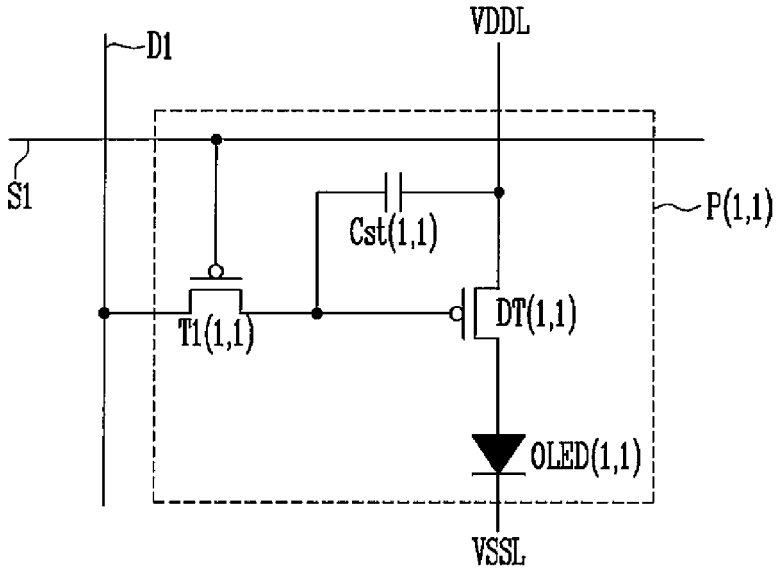
FIG. 2 is a schematic diagram for describing one embodiment of a pixel in the organic light emitting display device of FIG. 1.

FIG. 2 is a diagram for describing one embodiment of a pixel in the organic light emitting display device of FIG. 1. For the convenience of explanation, the embodiment of the pixels is described using pixel P(1, 1) as an example.

The pixel P(1, 1) is electrically connected to the scan line S1, a first power supply line VDDL, a second power supply line VSSL and a data line D1, and includes a first transistor T1(1, 1), a storage capacitor Cst(1, 1), a driving transistor DT(1, 1) and an organic light emitting diode OLED(1, 1). The storage capacitor Cst(1, 1) is electrically connected between a gate electrode of the driving transistor DT(1, 1) and the first power supply line VDDL. An anode electrode of the organic light emitting diode OLED(1, 1) is electrically connected to one of the electrodes of the driving transistor DT(1, 1), and a cathode electrode of the organic light emitting diode OLED(1, 1) is electrically connected to the second power supply line VSSL.

When the scan signals are supplied to the scan line S1, the first transistor T1(1, 1) is turned on, and the gate electrode of the driving transistor DT(1, 1) is electrically connected to the data line D1. Therefore, the data voltage which was supplied to the data line D1 is also supplied to the gate electrode of the driving transistor DT(1, 1). When the supply of the scan signal is finished, a difference between voltage levels of the gate electrode and the source electrode of the driving transistor DT(1, 1) is maintained by the storage capacitor Cst(1, 1). A current is supplied from the first power supply line VDDL to the organic light emitting diode OLED(1, 1), and the current which passed through the organic light emitting diode OLED(1, 1) arrives at the second power supply line VSSL. A level of the current supplied to the organic light emitting diode OLED(1, 1) is determined by the difference between voltage levels of the gate electrode and the source electrode of the driving transistor DT(1, 1). The organic light emitting diode OLED (1, 1) emits light by using the supplied current, and the emitted light can be displayed to a user. In some embodiments, the pixel P(a, b) is electrically connected to a scan line Sa and a data line Db.

Figure 3:
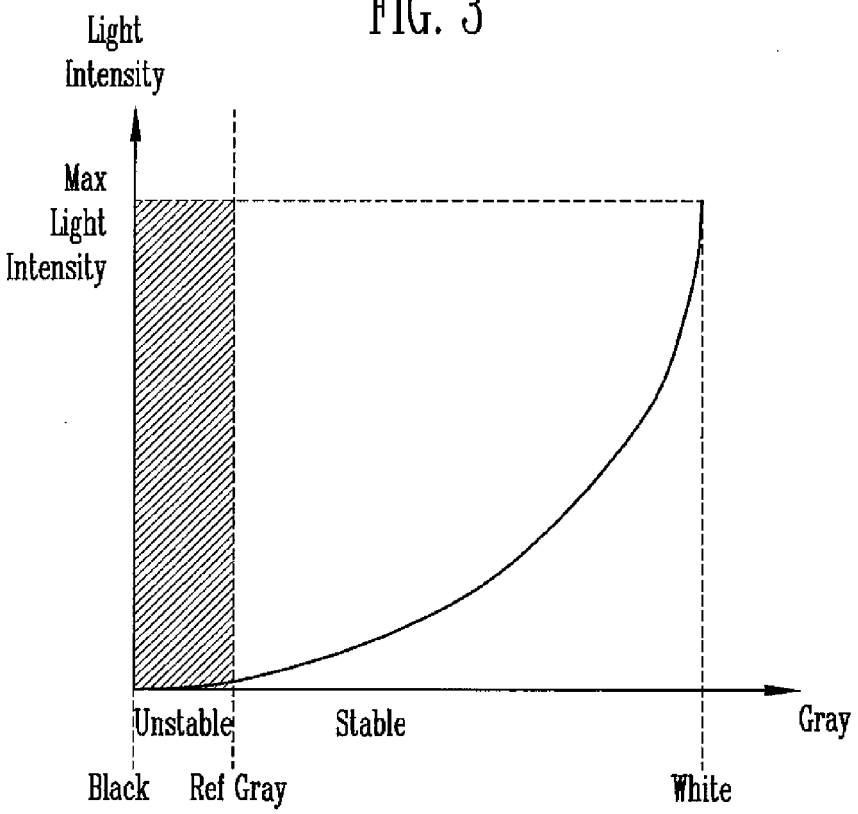
FIG. 3 is a diagram for describing a method of displaying pixels in the organic light emitting display device of FIG. 1.

FIG. 3 is a diagram for describing a method of displaying pixels in the organic light emitting display device of FIG. 1. For the convenience of explanation, one pixel P(a, b) among pixels P is taken as an example.

When the grayscale value, which corresponds to the pixel P(a, b) is higher than the black grayscale value and lower than a reference grayscale value Ref Gray, and is included in a first region Unstable, the luminance to current efficiency of the organic light emitting diode in the pixel P(a, b) becomes unstable, which is recognized by a user as a blur. Thus, the grayscale value, which corresponds to the pixel P(a, b), is changed to be higher than or equal to the reference grayscale value Ref Gray or to the black grayscale value. A detailed process of changing the grayscale value, which corresponds to the pixel P(a, b), will be described later in more detail. When the grayscale value, which corresponds to the pixel P(a, b), is greater than or equal to the reference grayscale value Ref Gray and is included in a second region Stable, the luminance to current efficiency of the organic light emitting diode OLED(a, b) in the pixel P(a, b) is stable. Therefore, the grayscale value, which corresponds to the pixel P(a, b), is supplied to the pixel P(a, b) unchanged. In an embodiment of the present invention, the reference grayscale value Ref Gray is determined based on the reference grayscale variable, and the variation of the reference grayscale value Ref Gray will be described later.

FIG. 4 is a diagram for describing low grayscale pixels displayed by the method of FIG. 3. For the convenience of explanation, pixels P(0, 0)-P(6, 7) and pixels P(0, 0)-P(6, 7) among the pixels P will be explained.

Figure 4A:
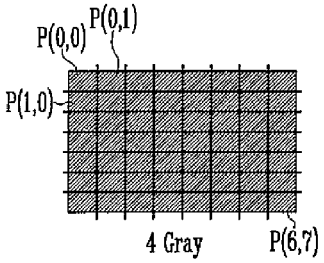
FIGS. 4A-4C are diagrams for describing low grayscale pixels displayed by the method of FIG. 3.

FIG. 4A is a diagram for describing the grayscales which correspond to the pixels P(0, 0)-P(6, 7). The grayscale values which correspond to the pixels P(0, 0)-P(6, 7) in FIG. 4A, are all 4s. For the convenience of explanation, a case where the reference grayscale value Ref Gray, which corresponds to the pixels P(0, 0)-P(6, 7), is 6 will be explained as an example. Since the grayscale values, which correspond to the pixels P(0, 0)-P(6, 7), are all higher than 0 and lower than 6, the timing controller 220 determines that the pixels P(0, 0)-P(6, 7) are low grayscale pixels, and changes the grayscale values which correspond to the pixels P(0, 0)-P(6, 7). It is assumed that the grayscale values which correspond to the pixels P(0, 0)-P(6, 7) are displayed for at least 2 frames.

Figure 4B:
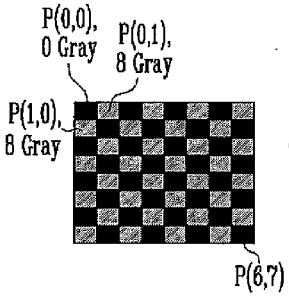

FIG. 4B is a diagram for describing a screen on which the pixels P(0, 0)-P(6, 7) are actually displayed for a first frame. When a driving frequency of the organic light emitting display device is 240 Hz, the first frame is displayed for 1/240 second. During the first frame (frame 1), the low grayscale pixel, which is adjacent to the low grayscale pixel displaying the black grayscale value in the first direction or the second direction, does not display the black grayscale value, and the low grayscale pixel, which is adjacent to the low grayscale pixel not displaying the black grayscale value in the first direction or the second direction, displays the black grayscale value. For example, based on a value a+b of the pixel P(a, b), it can be determined whether the black grayscale value is displayed. When the a+b value of the pixel P(a, b) is an even number, the grayscale value, which corresponds to the pixel P(a, b), is changed to 0 (Black, 0 Gray). When the a+b value of the pixel P(a, b) is an odd number, the grayscale value, which corresponds to the pixel P(a, b), is changed to 8, not 0 (8 Gray). For example, since the a+b value of the pixel P(0, 0) is 0, and 0 is an even number, the black grayscale value is displayed. Since the a+b values of pixel P(0, 1) and pixel P(1, 0), which are adjacent to the pixel P(0, 0) in the first direction or the second direction, are 1, and 1 is an odd number, a grayscale value, which is not the black grayscale value is displayed (8 Gray). The grayscale values, which correspond to the pixel P(0, 1) and the pixel P(1, 0), are greater than the reference grayscale value Ref Gray.

Figure 4C:
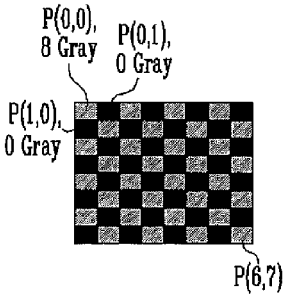

FIG. 4C is a diagram for describing a screen on which the pixels P(0, 0)-P(6, 7) are actually displayed for a second frame. It can be assumed that the second frame (frame 2) is displayed immediately after the first frame (frame 1). Based on a value a+b of the pixel P(a, b), it can also be determined whether the black grayscale value is displayed for the second frame (frame 2). Although the black grayscale value is displayed when the a+b value is an even number for the first frame (frame 1), the black grayscale value is displayed when the a+b value is an odd number for the second frame (frame 2). When the a+b value is an even number, the grayscale value, which corresponds to the pixel P(a, b), is changed to 8, not 0 (8 Gray). For example, since the a+b value of the pixel P(0, 0) is 0, and 0 is an even number, the grayscale value, which is not the black grayscale value is displayed (8 Gray). Since the a+b values of pixel P(0, 1) and pixel P(1, 0), which are adjacent to the pixel P(0, 0) in the first direction or the second direction, are 1s, and 1 is an odd number, the grayscale values, which correspond to the pixel P(0, 1), and the pixel P(1, 0) are changed to 0 (0 Gray).

A case in which the grayscale values, which correspond to the pixels P(0, 0)-P(6, 7), are 4s for 2 frames as in FIG. 4A, and a case in which the grayscale values, which correspond to the pixels P(0, 0)-P(6, 7), are 0s or 8s as in FIG. 4B and FIG. 4C, will be compared with each other. When the grayscale values, which correspond to the pixels P(0, 0)-P(6, 7), are 4s for 2 frames as in FIG. 4A, an average grayscale value at which one of the pixels P(0, 0)-P(6, 7) emit light is 4. When the grayscale values, which correspond to the pixels P(0, 0)-P(6, 7), are 0s or 8s as in FIG. 4B and FIG. 4C, the grayscale value which corresponds to the first frame (frame 1) or the second frame (frame 2) for each of the pixels P(0, 0)-P(6, 7) is 8. Therefore, the emitted average grayscale value is (0+8)/2=4. Thus, a difference between the case in which the grayscale values, which correspond to the pixels P(0, 0)-P(6, 7), are 4s for 2 frames as in FIG. 4A, and the case in which the grayscale values, which correspond to the pixels P(0, 0)-P(6, 7), are 0s or 8s as in FIG. 4B and FIG. 4B, is not recognized by users. However, since the pixels P(0, 0)-P(6, 7) are not driven to be greater than the black grayscale value or to be smaller than or equal to the reference grayscale value, the luminance to current efficiency of the organic light emitting diode is stabilized, and the viewers cannot recognize the blurs.

Figure 5:
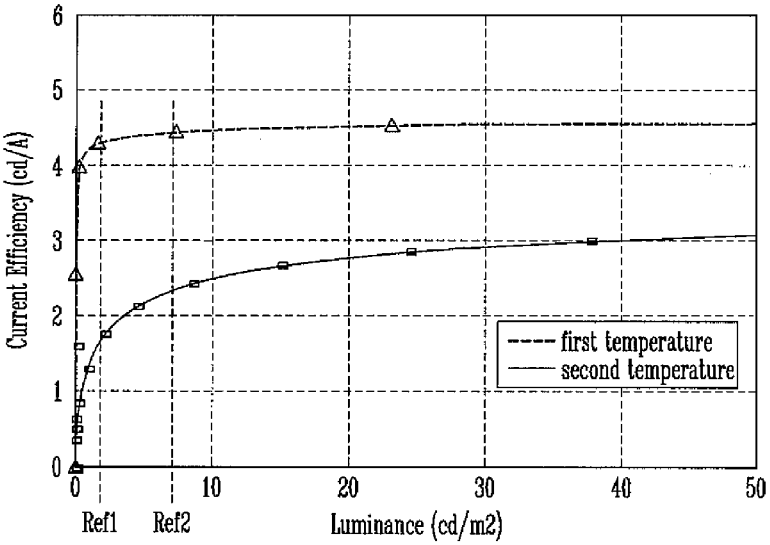
FIG. 5 is a diagram for describing a determination of a reference grayscale value based on a temperature.

FIG. 5 is a diagram for describing the determination of the reference grayscale value based on a temperature. In the embodiment described by referring to FIG. 5, the reference grayscale variable includes a temperature of the display panel 100. The temperature of the display panel 100 can be measured by a temperature sensor within the display panel 100.

For example, as the temperature of the display panel 100 rises, a brightness range in which a slope of the brightness (luminance) to current efficiency is smaller than a set (e.g., preset) slope (a range in which the current efficiency is predicted to be stable) is decreased. For example, when the temperature of the display panel 100 is a first temperature (first temperature), the luminance should be higher than a first reference luminance Ref1 in order to stabilize the luminance (candela per square meter, cd/$m^2$) to current efficiency (candela per ampere, cd/A) of the organic light emitting diode. When the temperature of the display panel 100 is a second temperature (second temperature), the luminance should be higher than a second reference luminance Ref2 in order to stabilize the luminance to current efficiency of the organic light emitting diode. When the slope of the luminance to current efficiency is smaller than the set (e.g., preset) slope, it can be determined that the luminance to current efficiency is stabilized. Accordingly, the luminance to current efficiency of the organic light emitting diode is stabilized when it is included in a second range (Stable), which is higher than the reference grayscale value Ref Gray. Therefore, according to an embodiment of the present invention, the grayscale value, which corresponds to the reference luminance, is set as the reference grayscale value. According to an embodiment, the second temperature is higher than the first temperature, and the first temperature can be an ambient temperature. Also, the second reference luminance Ref2 is higher than the first reference luminance Ref1. Since the luminance gets higher as the grayscale value rises, the second reference grayscale value, which corresponds to the second reference luminance Ref2, is higher than the second reference grayscale value, which corresponds to the first reference luminance Ref1. That is, when the temperature of the display panel is a first temperature, the reference grayscale value is determined to be the first reference grayscale value, which corresponds to the first reference luminance Ref1, and when the temperature of the display panel is a second temperature, which is higher than the first temperature, the reference grayscale value is determined to be the second reference grayscale value, which corresponds to the second reference luminance Ref2, and the second reference grayscale value is higher than the first reference grayscale value.

Figure 6:
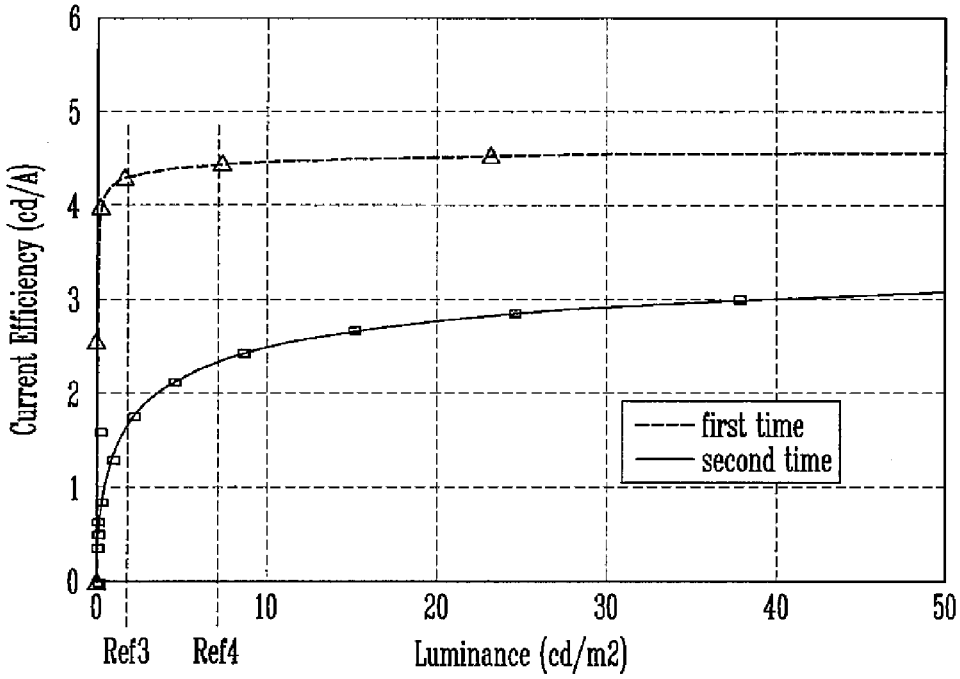
FIG. 6 is a diagram for describing a determination of a reference grayscale value based on a time period when a selected pixel emits light.

FIG. 6 is a diagram for describing the determination of the reference grayscale value based on a time period when the selected pixel emits light. For the convenience of explanation, it is assumed that the pixel P(a, b) is selected. In the embodiment described by referring to FIG. 6, the reference grayscale variable includes a time period when the pixel P(a, b) emits light. The time period when the pixel P(a, b) emits light can be counted by using a counter which counts the time period when the respective pixels emit light. The counter can be included in the display panel driver 200 or the display panel 100.

For example, as the time period when the pixel P(a, b) emits light gets longer, the range in which the current efficiency is stably predicted is decreased. For example, when the time period when the pixel P(a, b) emits light is a first time period (first time), the luminance is higher than a third reference luminance Ref3 in order to stabilize the luminance to current efficiency of the organic light emitting diode. When the time period when the pixel P(a, b) emits light is a second time period (second time), the luminance is higher than a fourth reference luminance Ref4 in order to stabilize the luminance to current efficiency of the organic light emitting diode. The second time period is longer than the first time period, and the first time period can be time 0. Thus, according to an embodiment of the present invention, the grayscale value, which corresponds to the reference luminance is set as the reference grayscale value. Also, the fourth reference luminance Ref4 is higher than the third reference luminance Ref3. Since the luminance gets higher as the grayscale value gets higher, the fourth reference grayscale value which corresponds to the fourth reference luminance Ref4 is higher than the third reference grayscale value which corresponds to the third reference luminance Ref3. That is, when the time period when the pixel P(a, b) emits light is a first time period, the reference grayscale value is determined to be the third reference grayscale value, which corresponds to the third reference luminance Ref3, and the reference grayscale value is determined to be the fourth reference grayscale value, which corresponds to the fourth reference luminance Ref4, when the time period when the pixel P(a, b) emits light is a second time period, which is longer than the first time period, wherein the fourth reference grayscale value is higher than the third reference grayscale value.

Figure 7:
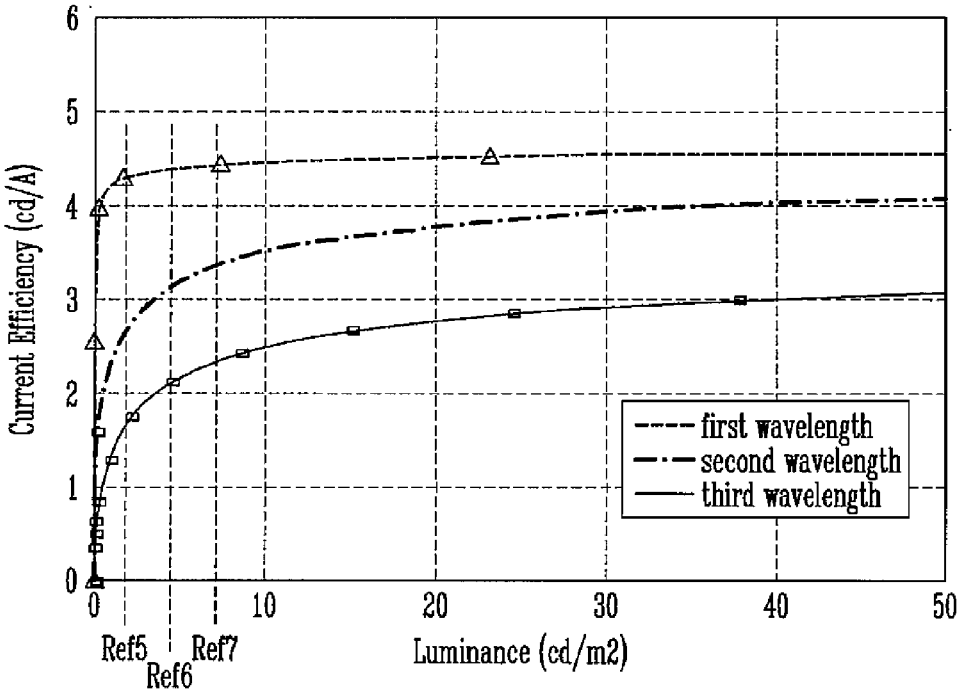
FIG. 7 is a diagram for describing a determination of a reference grayscale value based on a wavelength of light emitted by a selected pixel.

FIG. 7 is a diagram for describing the determination of the reference grayscale value based on a wavelength of the light emitted by the selected pixel. For the convenience of explanation, it is assumed that the pixel P(a, b) is selected. In the embodiment described by referring to FIG. 7, the graph includes wavelengths of the light emitted by the pixel P(a, b). Although the wavelength of the light emitted by the pixel P(a, b) can be directly measured, it can also be estimated based on the position of the pixel P(a, b) in the display panel 100. For example, a wavelength of the light emitted by the pixels which are electrically connected to 3*k*-th data lines (D3K, wherein k is an integer not smaller than 0) is a first wavelength (for example, the wavelength included in a red light region), a wavelength of the light emitted by the pixels which are electrically connected to (3*k*+1)-th data lines D3*k*+1 is a second wavelength shorter than the first wavelength (for example, the wavelength included in a green light region), and a wavelength of the light emitted by the pixels which are electrically connected to (3*k*+2)-th data lines D3*k*+2 can be a third wavelength shorter than the second wavelength (for example, the wavelength included in a blue light region).

For example, the range in which the current efficiency is stably predicted is varied based on the material constituting a light emitting layer of the organic light emitting diode. The wavelength of the emitted light is determined based on the material constituting the light emitting layer. For the organic light emitting display device according to an embodiment of the present invention, three colors (red R, green G, and blue B) are used; however, more or less colors can be used in other embodiments. Since the wavelength of the emitted light is different, so are the material constituting the light emitting layer and the range in which the current efficiency is stably predicted. For example, when the pixel P(a, b) emits light having a first wavelength (first wavelength), the luminance is higher than a fifth reference luminance Ref5 in order to stabilize the luminance to current efficiency of the organic light emitting diode. When the pixel P(a, b) emits light having a third wavelength (third wavelength) which is shorter than the second wavelength (second wavelength), the luminance is higher than a seventh reference luminance Ref7 in order to stabilize the luminance to current efficiency of the organic light emitting diode. Here, the first wavelength (first wavelength) can be included in the red light region, the second wavelength (second wavelength) can be included in the green light region, and the third wavelength (third wavelength) can be included in the blue light region. In an embodiment of the present invention, the grayscale value, which corresponds to the reference luminance, is set as the reference grayscale value. Also, the sixth reference luminance Ref6 is higher than the fifth reference luminance Ref5 and lower than the seventh reference luminance Ref7. Since the luminance gets higher as the grayscale value gets higher, the sixth reference grayscale value, which corresponds to the sixth reference luminance Ref6, is higher than the fifth reference grayscale value, which corresponds to the fifth reference luminance Ref5, and is lower than the seventh reference grayscale value, which corresponds to the seventh reference luminance Ref7. That is, the reference grayscale value is determined to be the fifth reference grayscale value, which corresponds to the fifth reference luminance Ref5, when the pixel P(a, b) emits light having a first wavelength (first wavelength), the reference grayscale value is determined to be the sixth reference grayscale value, which corresponds to the sixth reference luminance Ref6, when the pixel P(a, b) emits light having a second wavelength (second wavelength), which is shorter than the first wavelength (first wavelength), and the reference grayscale value is determined to be the seventh reference grayscale value, which corresponds to the seventh reference luminance Ref7, when the pixel P(a, b) emits light having a third wavelength (third wavelength), which is shorter than the second wavelength (second wavelength). The sixth reference grayscale value is higher than the fifth reference grayscale value and lower than the seventh reference grayscale value. However, it can be changed when the material constituting the light emitting layer, which emits light having one of the first to third wavelengths, is changed.

Figure 8:
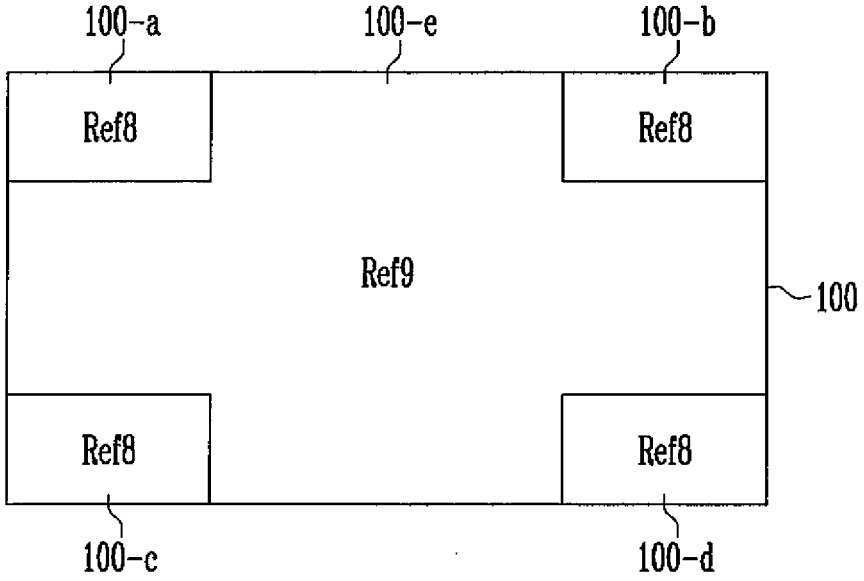
FIG. 8 is a diagram for describing that a reference grayscale value can have different values according to a position of a selected pixel in a display panel.

FIG. 8 is a diagram for describing that the reference grayscale value can have different values according to a position of the selected pixel in the display panel. In the display panel 100, not all pixels P emit light during the same time period. There are pixels which emit light for a longer time period while there are pixels which emit light for a shorter time period. In the embodiment described by referring to FIG. 8, the reference grayscale value includes a time period when the pixels P emit light, and for the convenience of explanation, it is assumed that the pixels, which are arranged at four corners of the display panel 100, emit light for a relatively long time period.

When referring to FIG. 8, it can be determined that a first part 100-*a*, a second part 100-*b*, a third 100-*c*, and a fourth part 100-*d* can be determined to correspond to four corners of the display panel 100, and it can be determined that the fifth part, which is obtained by excluding the first to fourth parts (100-*a*-100-*d*) of the display panel 100, corresponds to the rest of the display panel 100 without the four corners. Since the pixels included in the first to fourth parts (100-*a*-100-*d*) emit light for a relatively long time period, the reference grayscale value can be determined to be an eighth reference grayscale value Ref8. Since the pixels included in the fifth part (100-*e*) emit light for a relatively short time period, the reference grayscale value can be determined to be a ninth reference grayscale value Ref9. Since the range in which the current efficiency is stably predicted is decreased as the time period when light is emitted increases, the eighth reference grayscale value Ref8 is higher than the ninth reference grayscale value Ref9.

Figure 9:
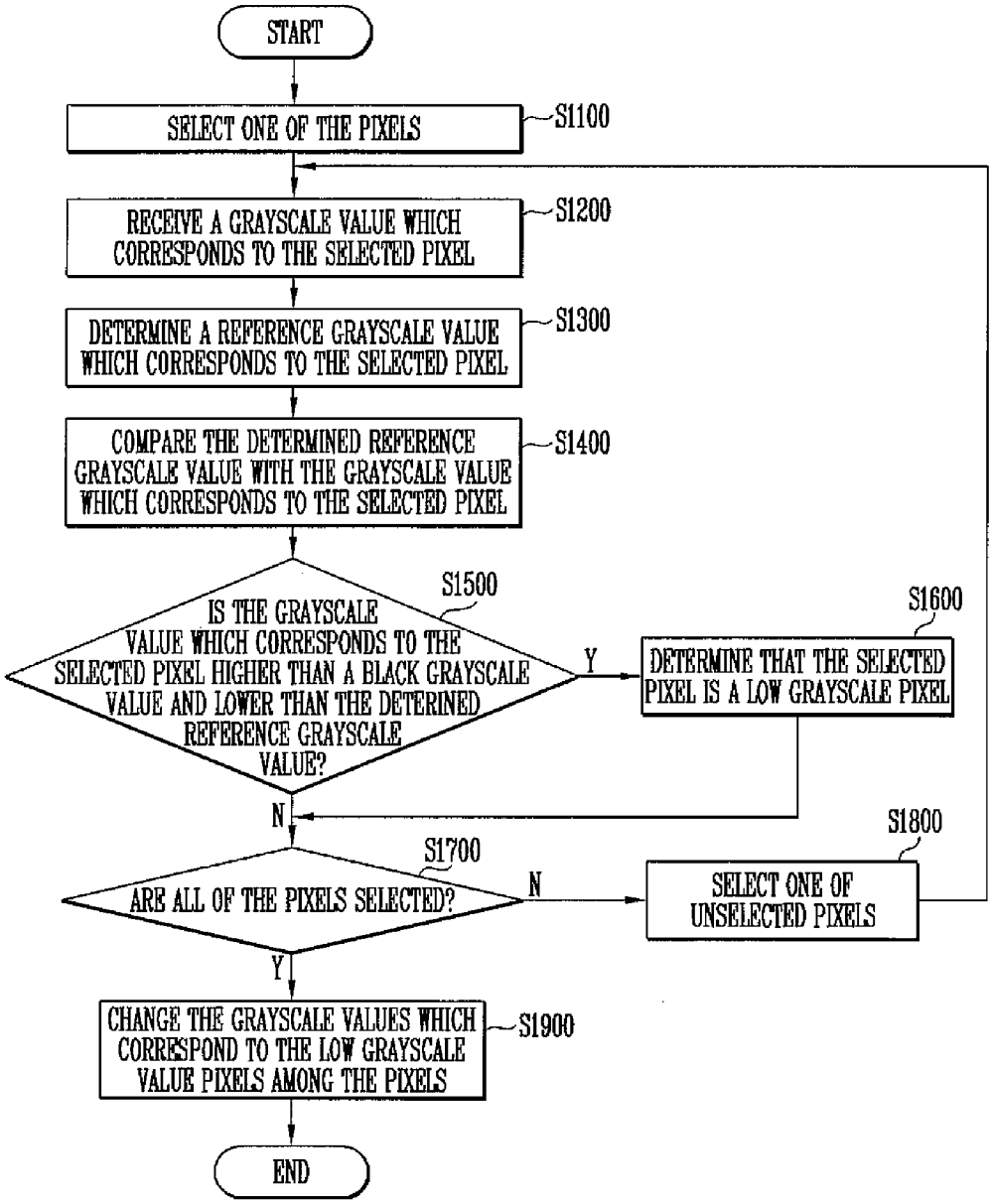
FIG. 9 is a flow chart diagram for describing a method of driving an organic light emitting display device according to one embodiment of the present invention.

FIG. 9 is a flow diagram for describing a method of driving the organic light emitting display device according to one embodiment of the present invention. In the following, a method of driving an organic light emitting display device will be described by referring to FIGS. 1-8.

In act S1100, one of the pixels P is selected. For the convenience of explanation, it is assumed that the pixel P(a, b) is selected. That is, the selected pixel is the pixel P(a, b).

In act S1200, the grayscale value, which corresponds to the pixel P(a, b) is received. The timing controller 220 receives the grayscale value which corresponds to the pixel P(a, b) by receiving an image signal RGB(a, b).

In act S1300, the timing controller 220 determines the reference grayscale value, which corresponds to the pixel P(a, b). Act S1300 will be explained in more detailed by referring to FIGS. 10-11 in the following.

In act S1400, the timing controller 220 compares the reference grayscale value, which corresponds to the pixel P(a, b) with the grayscale value, which corresponds to the pixel P(a, b).

In act S1500, when the grayscale value, which corresponds to the pixel P(a, b) is higher than the black grayscale value and lower than the reference grayscale value, which corresponds to the pixel P(a, b), act S1600 is performed.

In act S1600, since the grayscale value, which corresponds to the pixel P(a, b) is higher than the black grayscale value and lower than the reference grayscale value, which corresponds to the pixel P(a, b), the timing controller 220 determines that the pixel P(a, b) is a low grayscale pixel.

In act S1700, whether or not all pixels P have been selected is determined. If all of the pixels P have been selected, act S1900 is performed since it has been determined for all pixels P whether or not the pixels are low grayscale pixels. Otherwise, act S1800 is performed.

In act S1800, one of the pixels, which has not been selected, is selected.

In act S1900, the grayscale values, which correspond to the low grayscale pixels of the pixels P are changed since it has been determined for all pixels P whether or not the pixels are low grayscale pixels. The grayscale values, which correspond to some of the low grayscale pixels are changed to the black grayscale value, while the grayscale values, which correspond to the rest of the low grayscale pixels are changed to grayscale values, which are higher than the reference grayscale values of the low grayscale pixels, which correspond to each of the grayscale values.

Figure 10:
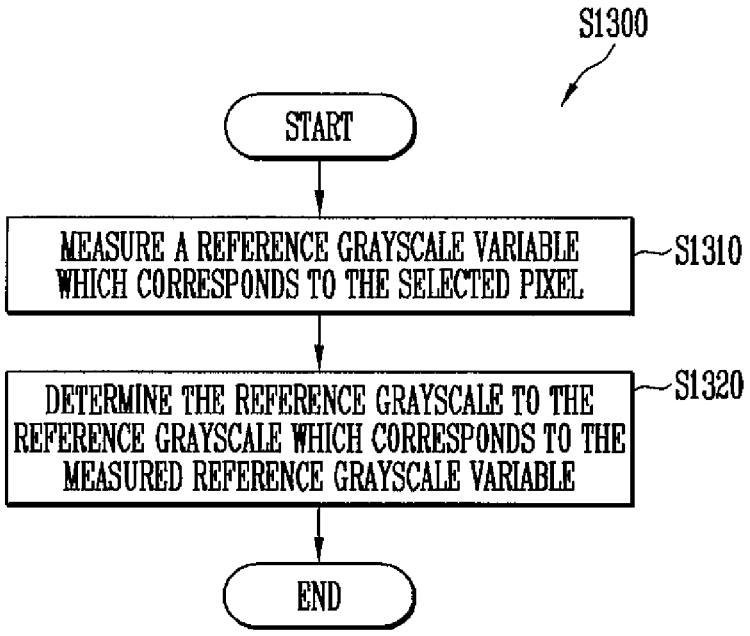
FIG. 10 is a flow chart diagram for describing an act of a method of driving an organic light emitting display device, for determining a reference grayscale value which corresponds to a selected pixel.

FIG. 10 is a flow diagram for describing an act of the method of driving the organic light emitting display device, for determining a reference grayscale value, which corresponds to the selected pixel.

In act S1310, a reference grayscale variable, which corresponds to the pixel P(a, b) is measured. Act S1310 will be explained in more detail by referring to FIG. 11 in the following description.

In act S1320, the reference grayscale value is determined to the reference grayscale value, which corresponds to the measured reference grayscale variable. When the reference grayscale look-up table 221 included in the timing controller 220 receives the reference grayscale variable, it outputs the reference grayscale value, which corresponds to the reference grayscale variable. That is, the reference grayscale value is determined based on the reference grayscale look-up table 221.

Figure 11:
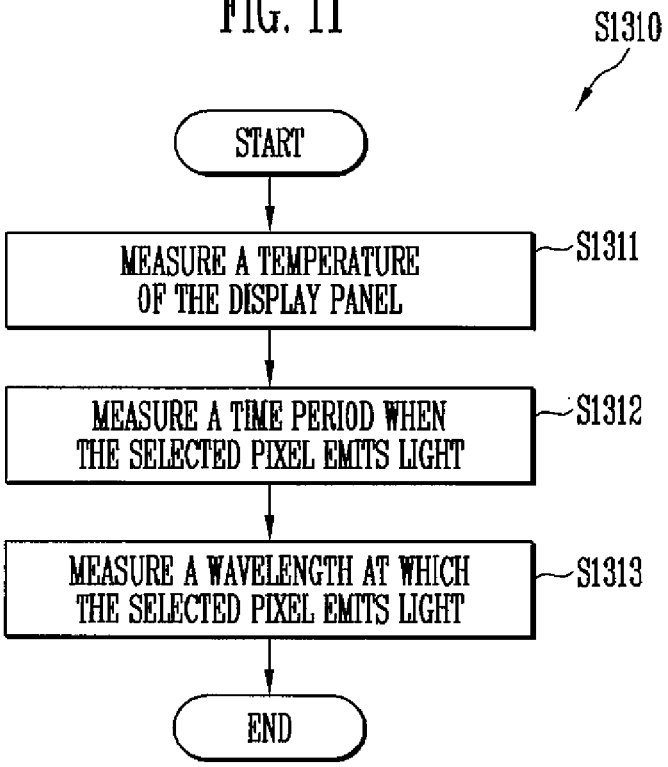
FIG. 11 is flow chart a diagram for describing an act of the method of driving an organic light emitting display device, for measuring a reference grayscale value variable which corresponds to the selected pixel.

FIG. 11 is a flow diagram for describing an act of the method of driving the organic light emitting display device, for measuring a reference grayscale variable which corresponds to the selected pixel selected pixel.

In act S1311, a temperature of the display panel 100 is measured. The temperature of the display panel 100 can be measured by a temperature sensor within the display panel 100.

In act S1312, a time period when the pixel P(a, b) emits light is measured. The time period when the pixel P(a, b) emits light can be counted by using a counter which counts the time period when the respective pixels emit light. The counter can be included in the display panel driver 200 or the display panel 100.

In act S1313, a wavelength of the light emitted by the pixel P(a, b) is measured. Although the wavelength of the light emitted by the pixel P(a, b) can be directly measured, it can also be estimated based on the position of the pixel P(a, b) in the display panel 100.

Although it is shown that acts S1311-S1313 are performed sequentially in FIG. 11, this pertains to one embodiment. The order of performing the acts S1311-S1313 can be changed, and some of the acts S1311-S1313 can be omitted based on the reference grayscale variable. For example, when reference grayscale variable includes the temperature of the display panel 100, act S1312 and act S1313 can be omitted.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the terms "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and/or hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Exemplary embodiments have been disclosed herein, and although specific terms are employed, they are used and are to be interpreted in a generic and descriptive sense and not for purpose of limitation. In some instances, as would be apparent to one of ordinary skill in the art at the time of filing of the present application, features, characteristics, and/or elements described in connection with a particular embodiment may be used singly or in combination with features, characteristics, and/or elements described in connection with other embodiments unless otherwise specifically indicated. Accordingly, it will be understood by those having ordinary skill in the art that various changes in form and details may be made without departing from the spirit and scope of the present invention as set forth in the following claims and their equivalents.

What is claimed is:

1. An organic light emitting display device comprising:

a display panel comprising pixels, each of the pixels comprising an organic light emitting diode; and a display panel driver configured to drive the display panel, wherein the display panel driver is configured to:

select one of the pixels, determine a reference grayscale value which corresponds to the selected pixel, compare a grayscale value which corresponds to the selected pixel with the reference grayscale value, and identify the selected pixel as a low grayscale pixel when the grayscale value which corresponds to the selected pixel is lower than the reference grayscale value and higher than a black grayscale value, wherein the low grayscale pixel displays the black grayscale value when there are more than one adjacent low grayscale pixels, wherein the reference grayscale value is determined based on a reference grayscale variable, wherein the reference grayscale variable comprises at least one of a temperature of the display panel, a time period when the selected pixel emits light, and a wavelength of light emitted by the selected pixel, wherein the pixels are arranged in a first direction and a second direction crossing the first direction, wherein the low grayscale pixel does not display the black grayscale value when the low grayscale pixel is adjacent the low grayscale pixel displaying the black grayscale value, and wherein the low grayscale pixel displays the black grayscale value when the low grayscale pixel is adjacent the low grayscale pixel not displaying the black grayscale value.

2. The organic light emitting display of claim 1, wherein the reference grayscale variable comprises the temperature of the display panel, wherein the reference grayscale value is determined as a first reference grayscale value when the temperature of the display panel is a first temperature, wherein the reference grayscale value is determined as a second reference grayscale value when the temperature of the display panel is a second temperature which is greater than the first temperature, and wherein the second reference grayscale value is higher than the first reference grayscale value.

3. The organic light emitting display of claim 1, wherein the reference grayscale variable comprises the wavelength of light emitted by the selected pixel, wherein the reference grayscale value is determined as a fifth reference grayscale value when the selected pixel emits light having a first wavelength, wherein the reference grayscale value is determined as a sixth reference grayscale value when the selected pixel emits light having a second wavelength which is shorter than the first wavelength, wherein the reference grayscale value is determined as a seventh reference grayscale value when the selected pixel emits light having a third wavelength which is shorter than the second wavelength, and wherein the sixth reference grayscale value is higher than the fifth reference grayscale value and lower than the seventh reference grayscale value.

4. The organic light emitting display of claim 1, wherein the display panel driver comprises a timing controller configured to receive image signals and timing signals from outside, the timing controller comprising a reference grayscale look-up table, and in response to the reference grayscale variable being inputted, the reference grayscale look-up table is configured to output a reference grayscale value which corresponds to the reference grayscale variable.

5. The organic light emitting display of claim 4, wherein in response to the selected pixel being identified as the low grayscale pixel, the timing controller is configured to change the grayscale value which corresponds to the selected pixel to the black grayscale value or a grayscale value higher than the reference grayscale value which corresponds to the selected pixel.

6. An organic light emitting display device comprising:

a display panel comprising pixels, each of the pixels comprising an organic light emitting diode; and a display panel driver configured to drive the display panel, wherein the display panel driver is configured to:

select one of the pixels, determine a reference grayscale value which corresponds to the selected pixel, compare a grayscale value which corresponds to the selected pixel with the reference grayscale value, and identify the selected pixel as a low grayscale pixel when the grayscale value which corresponds to the selected pixel is lower than the reference grayscale value and higher than a black grayscale value, wherein the low grayscale pixel displays the black grayscale value when there are more than one adjacent low grayscale pixels, wherein the reference grayscale value is determined based on a reference grayscale variable, wherein the reference grayscale variable comprises at least one of a temperature of the display panel, a time period when the selected pixel emits light, and a wavelength of light emitted by the selected pixel, wherein the reference grayscale variable comprises the time period when the selected pixel emits light, wherein the reference grayscale value is determined as a third reference grayscale value when the selected pixel emits light in a first time period, wherein the reference grayscale value is determined as a fourth reference grayscale value when the selected pixel emits light in a second time period which is longer than the first time period, and wherein the fourth reference grayscale value is higher than the third reference grayscale value.

7. A method of driving an organic light emitting display device, the organic light emitting display device comprising a display panel comprising pixels and a display panel driver configured to drive the display panel, each of the pixels comprising an organic light emitting diode, the method comprising:

selecting one of the pixels;

receiving a grayscale value which corresponds to the grayscale value of the pixel;

determining a reference grayscale value which corresponds to the selected pixel;

comparing the determined reference grayscale value with the grayscale value which corresponds to the selected pixel;

identifying the selected pixel as a low grayscale pixel when the grayscale value which corresponds to the selected pixel is higher than a black grayscale value and lower than the determined reference grayscale value; and changing grayscale values which correspond to the low grayscale pixels, wherein some of the low grayscale pixels display the black grayscale value during the changing of the grayscale values.

8. The method of driving the organic light emitting display of claim 7, wherein the determining of the reference grayscale value which corresponds to the selected pixel comprises:

measuring a reference grayscale variable which corresponds to the selected pixel; and determining the reference grayscale value to the reference grayscale value which corresponds to the measured reference grayscale variable.

9. The method of driving the organic light emitting display of claim 8, wherein the measuring the reference grayscale variable comprises at least one of:

measuring a temperature of the display panel;

measuring a time period when the selected pixel emits light; and measuring a wavelength of light emitted by the selected pixel.

10. The method of driving the organic light emitting display of claim 9, wherein the measuring the wavelength of light comprises estimating the wavelength of the light based on a relative position of the selected pixel in the display panel.

11. The method of driving the organic light emitting display of claim 8, wherein the determining of the reference grayscale value to the reference grayscale value which corresponds to the measured reference grayscale variable, comprises determining the reference grayscale value based on a reference grayscale look-up table in the display panel driver.

* * * * *